United States Patent [19]

Trotta

[11] 4,422,237

[45] Dec. 27, 1983

[54] RAZOR HANDLE

[75] Inventor: Robert A. Trotta, Pembroke, Mass.

[73] Assignee: The Gillette Company, Boston, Mass.

[21] Appl. No.: 352,146

[22] Filed: Feb. 25, 1982

[51] Int. Cl.[3] ..... B26B 21/14

[52] U.S. Cl. ..... 30/85

[58] Field of Search ..... 30/32, 47, 50, 85, 51, 30/89, 62

[56] References Cited

U.S. PATENT DOCUMENTS

| | | | |
|---|---|---|---|
| 1,195,259 | 8/1916 | O'Reilly | 30/47 |
| 2,421,540 | 6/1947 | Clarke | 30/85 X |
| 2,654,148 | 10/1953 | Robinson | 30/32 |
| 2,750,664 | 6/1956 | Merlo | 30/89 X |
| 3,324,546 | 6/1967 | Chavez | 30/67 |

FOREIGN PATENT DOCUMENTS 905581 3/1954 Fed. Rep. of Germany .

1753939 4/1957 Fed. Rep. of Germany .

*Primary Examiner*—Jimmy C. Peters

*Attorney, Agent, or Firm*—Scott R. Foster

[57] ABSTRACT

A razor handle comprising an elongated grip portion, a neck portion extending from one end of the grip portion and disposed at an angle to the grip portion, and a protrusion extending from an end of the neck portion remote from the grip portion, the protrusion having opposed planar surfaces extending from a free end of the protrusion at which the surfaces are closest to each other to a base portion of the protrusion at which the surfaces are farthest apart, wedge-shaped end walls interconnecting the surfaces, a connecting web joining the protrusion to the neck portion and being of reduced thickness to provide a recess between the neck portion and the protrusion, the neck and grip portions, web, and protrusion being a unitary molding.

1 Claim, 4 Drawing Figures

RAZOR HANDLE

BACKGROUND OF THE INVENTION

1. Field of the Invention

The invention relates to wet shaving systems, and is directed more particularly to a razor handle suitable for use in such a system.

2. Description of the Prior Art

Shaving cartridges having blade elements permanently secured therein are well known in the art. Examples of such cartridges may be found in U.S. Pat. Nos. 1,864,995—T. H. Frost; 2,654,148—W. M. Robinson; 2,676,397—J. De Bacco et al; 3,388,831—B. S. Hansom; 3,660,893—N. C. Welsh; 3,703,764—R. L. Perry; 3,783,510—J. Dawidowicz; and 4,026,016—W. I. Nissen.

Several structures for interconnecting such cartridges and complimentary handles have been disclosed. For example, in Robinson, Perry and Dawidowicz, a slide arrangement is utilized, in Frost a screw connection is shown, in De Bacco and Hansom a cartridge is held between jaws; in Nissen a pivotal connection is disclosed.

In U.S. patent application Ser. No. 352,150, filed concurrently herewith, there is disclosed a shaving cartridge having a unique and improved means for interconnecting with a razor handle.

SUMMARY OF THE INVENTION

Accordingly, an object of the present invention is to provide a razor handle suitable for use with shaving units, or cartridges, of the type disclosed in the above referred to U.S. patent application Ser. No. 352,150, filed concurrently herewith.

With the above and other objects in view, as will hereinafter appear, a feature of the present invention is the provision of a razor handle comprising an elongated grip portion, a neck portion extending from one end of the grip portion at an angle thereto, said neck portion being formed in part by planar front and rear walls terminating at a free end of said neck portion, a protrusion extending from said free end of said neck portion, said protrusion being defined in part by a planar front wall facing in substantially the same direction as said neck portion front wall and a planar rear wall facing in substantially the same direction as said neck portion rear wall, said protrusion walls being inclined relative to each other so as to provide a free end of said protrusion narrower than a base portion of said protrusion, and a web means interconnecting said base portion of said protrusion and said free end of said neck portion, said web being of lesser thickness than said base portion to provide recess means between said base portion and said free end of said neck portion, said protrusion being of a plastic material.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
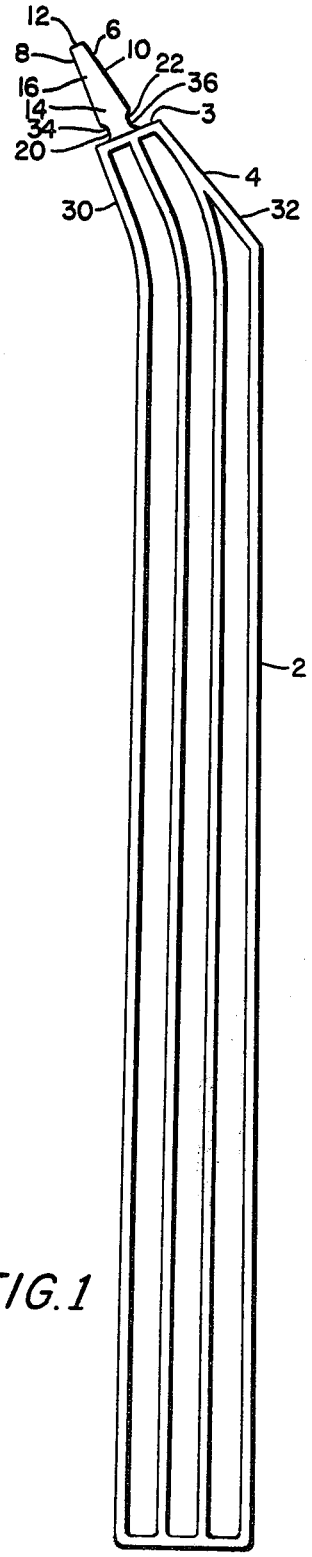
FIG. 1 is a side elevational view of one form of razor handle illustrative of an embodiment of the invention.
Figure 2:
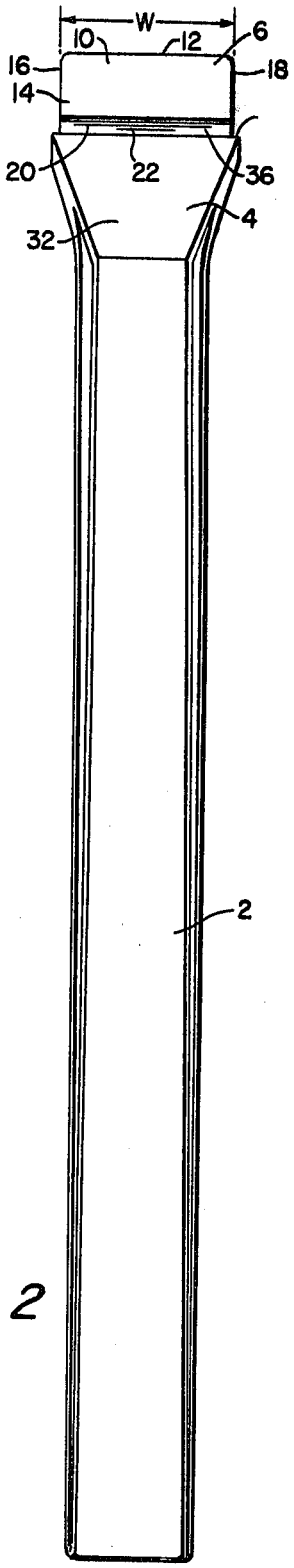
FIG. 2 is a rear elevational view thereof.
Figure 3:
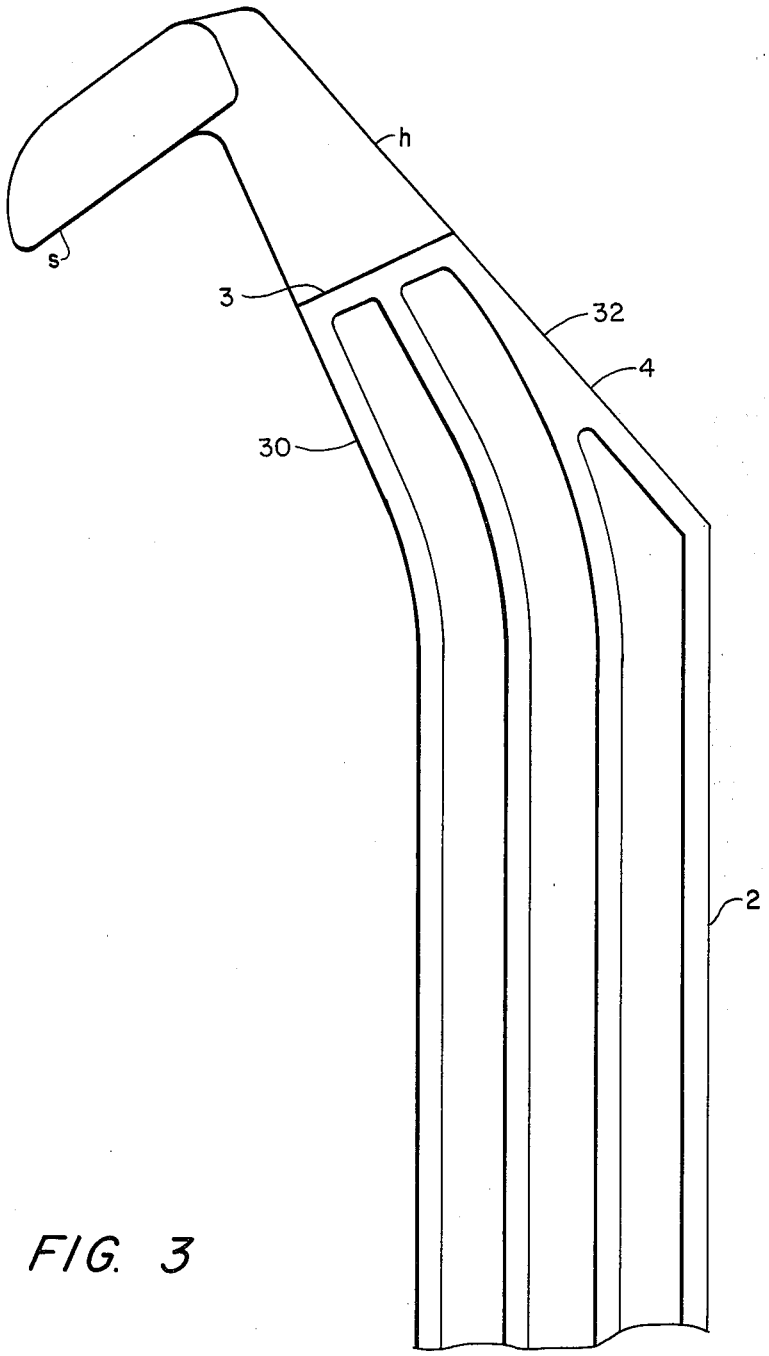
FIG. 3 is an enlarged side elevational view of a portion thereof, shown in combination with a shaving cartridge.

Referring to the drawings, it will be seen that the illustrative razor handle includes an elongated grip portion 2 and a neck portion 4 extending from one end of the grip portion and disposed at an angle to the grip portion.

Extending from an end 3 of the neck portion 4 remote from the grip portion 2 is a protrusion 6. The protrusion 6 has first and second major planar surfaces 8, 10 extending from a free end 12 of the protrusion, at which the surfaces 8, 10 are closest to each other, to a base portion 14, at which the surfaces 8, 10 are farthest apart. Substantially wedge-shaped end walls 16, 18 interconnect the surfaces 8, 10 along the side edges of the surfaces.

A connecting web 20 joins the base portion 14 of the protrusion 6 to the end 3 of the neck portion 4, the connecting web being of lesser thickness than the protrusion base portion, to provide recess means 22 between the end 3 of the neck portion 4 and the protrusion base portion 14.

The protrusion 6 is in substantial alignment with the neck portion 4, extending outwardly at an angle to the grip portion 2.

Referring to FIG. 1, it will be seen that the neck portion 4 is defined in part by front and rear walls 30, 32, preferably forming continuations, respectively, of front and rear walls of the grip portion. The first major planar surface 8 is in a plane substantially parallel to the plane of the front neck wall 30 and the second major planar surface 10 is at an angle thereto, such that at the free end 12 of the protrusion, the surfaces are closest together (preferably about 0.043 in.) and at the base portion 14 of the protrusion the surfaces are farthest apart (preferably about 0.093 in.). The protrusion is preferably about 0.25 in. in length l and 0.42 in. in width w. The recess means 22 preferably comprises two recesses 34, 36 defined in part by the web, which is about 0.066 in. in thickness t.

Figure 4:
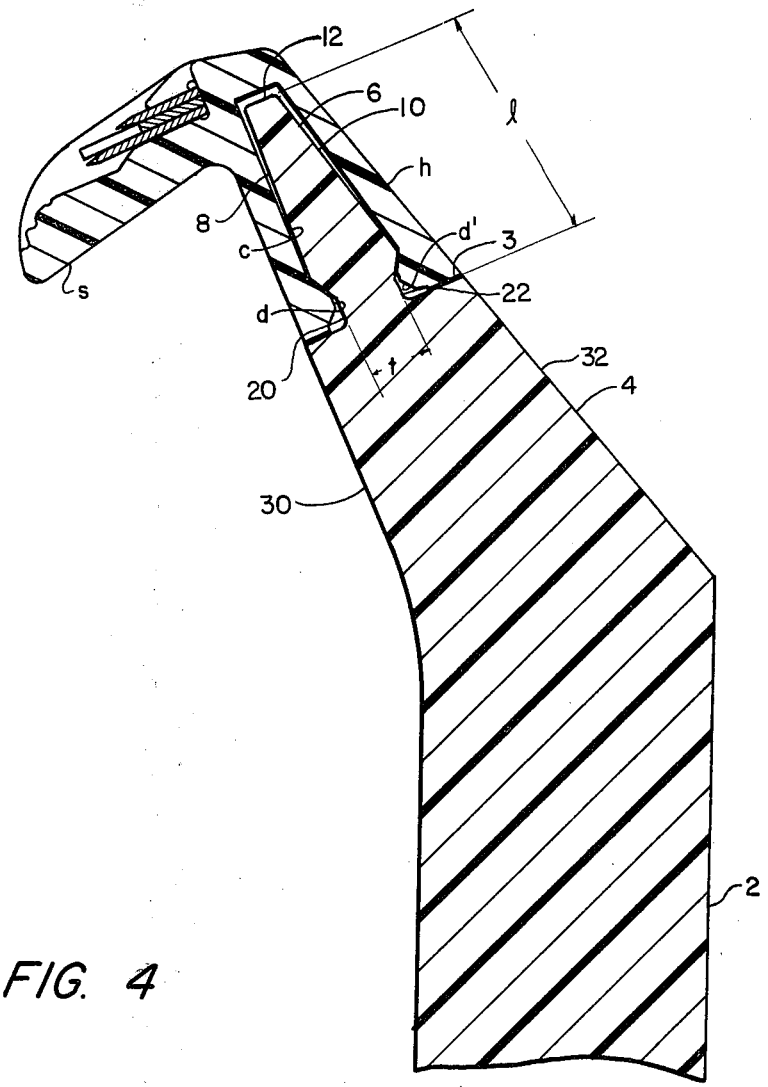
FIG. 4 is a side center-line sectional view, showing a portion of the illustrative handle in combination with a shaving cartridge.

In use (FIG. 4), the protrusion 6 is introduced into a cavity c, defined by a housing portion h of a shaving unit s, the housing portion h having inwardly directed opposed detents d, d'. The widest portion of the base portion 14, overrides the detents d, d', which snap into the recesses 34, 36 to lock the shaving unit s on the handle. Preferably, the grip portion, neck portion, web and protrusion are molded or cast integrally as a unit, of plastic or of a more rigid material, such as metal. Plastic deformation of the shaving unit housing portion permits withdrawal of the handle from the shaving unit and reuse with subsequent shaving units.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A razor handle comprising an elongated grip portion, a neck portion extending from one end of said grip portion, and a protrusion extending from an end of said neck portion remote from said grip portion, said protrusion having first and second major surfaces extending from a free end of the protrusion at which said surfaces are closest to each other, to a base portion of said protrusion at which said surfaces are farthest apart from each other, substantially wedge-shaped end walls interconnecting said surfaces along side edges of said surfaces, first and second lesser surfaces extending inwardly from said base portion and toward said end of said neck portion, a connecting web extending from said first and second lesser surfaces of said protrusion to said end of said neck portion, said connecting web being of lesser thickness than said protrusion base portion, whereby to provide recess means defined by said end of said neck portion and said protrusion web and said first and second lesser surfaces, said protrusion being in substantial alignment with said neck portion, and said grip portion, neck portion, web and protrusion being a unitary member.

* * * * *